US008737631B2

(12) United States Patent
Boretzki et al.

(10) Patent No.: US 8,737,631 B2
(45) Date of Patent: May 27, 2014

(54) METHOD FOR ADJUSTING A HEARING DEVICE WITH FREQUENCY TRANSPOSITION AND CORRESPONDING ARRANGEMENT

(75) Inventors: Michael Boretzki, Rueti (CH); Rene Buergin, Reichenburg (CH); Hugh McDermott, Mt. Macedon (AU)

(73) Assignee: Phonak AG, Stafa (CH)

( * ) Notice: Subject to any disclaimer, the term of this patent is extended or adjusted under 35 U.S.C. 154(b) by 349 days.

(21) Appl. No.: 12/671,299

(22) PCT Filed: Jul. 31, 2007

(86) PCT No.: PCT/EP2007/057887

§ 371 (c)(1),
(2), (4) Date: Jan. 29, 2010

(87) PCT Pub. No.: WO2007/135198

PCT Pub. Date: Nov. 29, 2007

(65) Prior Publication Data

US 2010/0202625 A1 Aug. 12, 2010

(51) Int. Cl.
*H04R 29/00* (2006.01)
*H04R 25/00* (2006.01)

(52) U.S. Cl.
USPC ..... 381/60; 381/316

(58) Field of Classification Search
USPC ..... 381/23.1, 312, 313, 314, 315, 316, 317, 381/318, 319, 320; 607/57
See application file for complete search history.

(56) References Cited

U.S. PATENT DOCUMENTS

| | | | | |
|---|---|---|---|---|
| 4,637,402 | A | 1/1987 | Adelman | |
| 5,285,499 | A | 2/1994 | Shannon et al. | |
| 5,682,463 | A | 10/1997 | Allen et al. | |
| 5,999,856 | A * | 12/1999 | Kennedy | 607/57 |
| 6,201,875 | B1 * | 3/2001 | Davis et al. | 381/314 |
| 6,212,496 | B1 | 4/2001 | Campbell et al. | |
| 2004/0264721 | A1 * | 12/2004 | Allegro et al. | 381/316 |
| 2005/0226427 | A1 * | 10/2005 | Hersbach et al. | 381/23.1 |
| 2007/0003077 | A1 * | 1/2007 | Pedersen et al. | 381/106 |
| 2007/0195979 | A1 * | 8/2007 | Thomasson et al. | 381/316 |
| 2007/0204695 | A1 * | 9/2007 | Gross et al. | 73/585 |

FOREIGN PATENT DOCUMENTS

| | | | |
|---|---|---|---|
| EP | 1441562 | A2 | 7/2004 |
| WO | 9525414 | A1 | 9/1995 |
| WO | 0122777 | A1 | 3/2001 |
| WO | 2004054318 | A1 | 6/2004 |

OTHER PUBLICATIONS

International Search Report for PCT/EP2007/057887 dated Nov. 19, 2007.
Written Opinion for PCT/EP2007/057887 dated Nov. 19, 2007.
Moore et al., "A test for the diagnosis of dead regions in the cochlea", British Journal of Audiology, vol. 34, No. 4, 2000, pp. 205-224.

* cited by examiner

*Primary Examiner* — Duc Nguyen
*Assistant Examiner* — Phan Le
(74) *Attorney, Agent, or Firm* — Pearne & Gordon LLP

(57) ABSTRACT

A method for adjusting a hearing system to the hearing preferences of a user of said hearing system is disclosed, wherein said hearing system is capable of carrying out frequency transposition of audio signals, which frequency transposition depends on at least one parameter. The method comprises the steps of A) carrying out a distinction test for examining said user's ability to distinguish between two stimulus signals which differ in their frequency contents;

B) adjusting said at least one parameter in dependence of the result of said distinction test.

The distinction test comprises the steps a2) consecutively playing said two stimulus signals to said user;

b2) receiving from said user information indicative of whether said user perceived said two stimulus signals as two times the same sound or as two different sounds;

c2) deriving a value from said information received from said user;

wherein said result of said distinction test is dependent on said value.

21 Claims, 4 Drawing Sheets

METHOD FOR ADJUSTING A HEARING DEVICE WITH FREQUENCY TRANSPOSITION AND CORRESPONDING ARRANGEMENT

TECHNICAL FIELD

The invention relates to an arrangement comprising a hearing system with frequency transposition and method for adjusting such a hearing system.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

A hearing system comprises at least one hearing device. In case that a hearing system comprises at least one additional device, all devices of the hearing system are operationally connectable within the hearing system. Typically, said additional devices such as another hearing device, a remote control or a remote microphone, are meant to be worn or carried by said individual. Analogously, a hearing-aid system comprises at least one hearing-aid device.

For purposes of this patent application, frequency transposition means a spectral modification of audio signals, which comprises shifting at least a portion of said audio signals from its original frequency range to a different frequency range. Frequency transposition typically comprises frequency shifting and/or frequency compression, wherein frequency shifting means that a portion of audio signals of an original frequency range is shifted to a new frequency range of the same frequency width in octaves, and frequency compression means that a portion of audio signals of an original frequency range is shifted to a new frequency range which has a different frequency width. Frequency transposition may also comprise reducing the playback speed of recorded audio signals while discarding portions of the signal in order to preserve the original duration.

Under audio signals we understand electrical signals, analogue and/or digital, which represent sound.

BACKGROUND OF THE INVENTION

From U.S. Pat. No. 4,637,402, it is known to measure the hearing deficit of a person and to fit a hearing aid to said person. Frequency bands are determined over which said person's hearing level is unacceptable, and these bands are then shifted—in a harmonic-sustaining manner—to bands with an acceptable hearing level. Said frequency bands are determined by means of a swept frequency tone generator. Furthermore, after initial values are chosen for the various gains and gainshaping elements, said person is then presented with well known word discrimination lists, i.e. spoken words which are known to differ in subtle ways from other words, and his test scores are taken. On the basis of the types of words that are missed and the spectral content of those words, the appropriate gain changes, and if necessary transposition placements and characters are altered. I.e., a recognition test is carried out, and dependent on the result of that recognition test, parameters related to the frequency transposition are altered.

In U.S. Pat. No. 6,212,496, a technique for producing an audio output customized to a listener's hearing impairment through a digital telephone is disclosed. By determining hearing thresholds for many frequencies, unacceptable regions (frequency ranges) are determined, in particular frequency bands in which the user cannot hear. The unacceptable band or bands is/are then mapped onto one or more acceptable bands.

It is desirable to provide an alternative way of adjusting parameters related to frequency transposition in a hearing system, and to provide a arrangement for carrying out such adjustments.

In WO 2004/054318 A1, a method for fitting a portable hearing device to a hearing-impaired user is disclosed. The method shall lead to well-adjusted frequency-dependent gain curves and comprises a consonant discrimination step, in which an A-B-discrimination test with the sound of the letter "s" present or absent is carried out. If the user can hear the difference, high frequencies are left unchanged; if the user cannot hear the difference, high frequencies are boosted. There is no mention of frequency transposition.

From EP 1 441 562 A2, hearing devices are known, in which frequency transposition is implemented. Methods for carrying out frequency transposition, in particular frequency compression, are therein disclosed in detail.

In B. C. J. Moore "A test for the diagnosis of dead regions in the cochlea", British Journal of Audiology Vol. 34, No. 4, 2000, pages 205-224, a procedure for measuring psychophysical tuning curves (PTCs) is disclosed. Said procedure comprises, for several test frequencies, determining the threshold of perception of a sinusoid of said test frequency in presence of a masker, wherein a noise band was used as the masker.

SUMMARY OF THE INVENTION

One object of the invention is to create a method for adjusting a hearing system with frequency transposition that provides an alternative to known methods. In addition, an arrangement for doing so shall be provided. And a use of distinction tests is provided, too.

Another object of the invention is to provide for an alternative way to determine candidacy of a user for the use of frequency transposition in the user's hearing system.

Another object of the invention is to provide for a method and an arrangement for adjusting a hearing system with frequency transposition, which can be used without or with only little prerequisites.

Another object of the invention is to provide for a way of adjusting a hearing system with frequency transposition, which is particularly fast, i.e., which can be carried out within a relatively short time.

Another object of the invention is to provide for a way of adjusting a hearing system with frequency transposition, which yields particularly reliable results.

Further objects emerge from the description and embodiments below.

At least one of these objects is at least partially achieved by methods and arrangements according to the patent claims.

The method for adjusting a hearing system to the hearing preferences of a user of said hearing system, wherein said hearing system is capable of carrying out frequency transposition of audio signals, which frequency transposition depends on at least one parameter, comprises the steps of A) carrying out a distinction test for examining said user's ability to distinguish between two stimulus signals which differ in their frequency contents;

B) adjusting said at least one parameter in dependence of the result of said distinction test.

The use according to the invention is a use of a distinction test in which the ability of a hearing system user to distinguish between two stimulus signals which differ in their frequency contents is investigated, for adjusting at least one parameter of said hearing system, which is capable of carrying out frequency transposition of audio signals, and wherein said frequency transposition depends on said at least one parameter.

Through this, an improved and/or simplified adjustment of said hearing system can be achieved. And/or it can be determined whether or not the use of frequency transposition is beneficial for said user.

As has been described above, from U.S. Pat. No. 4,637,402, it is known to use a recognition test (for certain words) in order to find out suitable values for parameters related to frequency transposition. A recognition test always asks the question "Is a certain sound recognized?" or "Does a certain sound remind of a sound known before?". Accordingly, a recognition test, such as a speech recognition test or a speech intelligibility test, relates to previous knowledge.

In U.S. Pat. No. 6,212,496, on the other hand, detection tests are carried out in order to find out suitable values for parameters related to frequency transposition. In a detection test, the question "Can I hear a certain sound?" is asked. Detection tests are typically used for determining threshold values, such as the hearing thresholds in U.S. Pat. No. 6,212,496. Accordingly, in detection tests, a level (threshold level) of a signal is determined at which a signal is barely or just not perceivable.

So far, the use and adjustment of frequency transposition features in hearing devices was basically linked to the detection of "unacceptable (frequency) regions", i.e. frequency ranges with particularly high hearing thresholds were used as an indicator for the use of frequency transposition and/or as a magnitude for determining values to be assigned to parameters related to the frequency transposition.

The inventors, however, found that the determination of the hearing system user's ability to distinguish between sounds of different frequency contents is a good indicator for the use of frequency transposition, and moreover, from examining said ability, information can be gained for adjusting parameters related to the frequency transposition.

Furthermore, the inventors found that while in many cases the existence of "unacceptable (frequency) regions" is a decent indicator for the use of frequency transposition, there are also cases in which no pronounced "unacceptable (frequency) region" exists, but nevertheless, frequency transposition turned out to be beneficial for the hearing system user and, vice versa, that there are cases in which frequency transposition did not turn out to be helpful despite the existence of pronounced "unacceptable (frequency) regions".

And moreover, the inventors found that investigating the hearing system user's ability to distinguish between signals in frequency space (instead of determining amplitudes) can be carried out beneficially in a distinction test. A distinction test always asks whether or not a difference can be perceived, such as "Can I hear a difference between the two sounds played to me? (Or are they indistinguishable to me?)" or "Which one of those (three or more) sounds is different from the others?".

From the result of such a distinction test, valuable information can be obtained with respect to the question of whether or not the use of frequency transposition will be beneficial for a user and/or which values should be selected in adjusting parameters related to the frequency transposition.

A distinction test needs only little prerequisites. It is relatively straight-forward for an individual tested in a distinction test to decide whether or not one perceives stimulus sounds as equal or as different. Unlike in recognition tests, no reference has to be made to previously known sounds, and there is also no indispensable need for firstly making a practically full fitting of the hearing system and waiting through an acclimatization time before starting a recognition test.

In a very simple embodiment, two stimulus signals of different frequency contents could be played to the user, and the user is asked to indicate whether he perceived the two signals as two times the same signal or as two different signals. If the user is able to distinguish the two signals, a default frequency transposition (with default parameter settings) will be invoked, whereas the frequency transposition feature is not used (switched off; neutral parameter adjustments) if the user perceives the difference.

In one embodiment, said hearing system is a hearing-aid system. In this case, said hearing preferences of said user will most importantly be determined by the user's hearing impairment.

In one embodiment, said frequency transposition is carried out by transforming audio signals into frequency space, thus obtaining a spectrum, transposing at least a portion of said spectrum to a different frequency range (shifting and/or compressing), thus obtaining a modified spectrum, and transforming said modified spectrum into time space, thus obtaining modified audio signals.

Examples for said parameter are a cutoff frequency, e.g., defining a frequency above which frequency compression sets in or a frequency limiting a frequency range to be shifted; a compression ratio; a frequency shift.

In one embodiment, said distinction test is related to a test frequency, and said two stimulus signals are both chosen in dependence of said test frequency.

In one embodiment, said distinction test is related to a test frequency, and said two stimulus signals are chosen such that the sum of their audio frequency spectra is substantially symmetrical with respect to said test frequency. The term "symmetrical" is preferably meant in an auditory sense, i.e. rather on a logarithmical Hertz scale than on a linear Hertz scale.

We used that term "audio frequency spectrum" in order to exclude low frequencies, in particular frequencies which are not audible. E.g., in the case of warbling sounds (pitch modulated sounds), the (low) modulation frequency shall not be considered.

In one embodiment, said distinction test relates to a test frequency, and each of said two stimulus signals has an audio frequency spectrum, which is substantially symmetrical with respect to said test frequency.

In one embodiment, said distinction test relates to a test frequency, and the audio frequency spectrum of one of said two stimulus signals is substantially symmetrical with respect to the audio frequency spectrum of the other of said two stimulus signals, with said test frequency forming substantially the corresponding symmetry axis.

In one embodiment, said two stimulus signals are substantially noises having different band widths, in particular narrow-band noises, e.g., having widths of one or two octaves or (rather) less. In particular, said noises with different band widths may have the same main frequency, in particular wherein said main frequency is substantially identical with said test frequency.

In one embodiment, said two stimulus signals are substantially narrow-band signals of different frequencies, in particular sine signals or narrow-band noises. Preferably, each of said narrow-band signals has a main frequency forming substantially the same interval with said test frequency, one above and one below said test frequency.

In one embodiment, said two stimulus signals are substantially narrow-band signals warbling with different warbling amplitudes around substantially the same middle frequency. Said narrow-band signals can be, e.g., sine signals or narrow-band signals. In particular, said middle frequency is substantially identical with said test frequency.

In one embodiment, carrying out said distinction test comprises a2) consecutively playing said two stimulus signals to said user;

b2) receiving from said user information indicative of whether said user perceived said two stimulus signals as two times the same sound or as two different sounds;

c2) deriving a value from said information received from said user;

wherein said result of said distinction test is dependent on said value.

In one embodiment, carrying out said distinction test comprises a3) consecutively playing three stimulus signals to said user, wherein these three are chosen from said two stimulus signals either freely or such that one of said two stimulus signals is played exactly once;

b3) receiving from said user information indicative of which of said consecutively played three stimulus signals was perceived as different from the other two, or indicative of which of said consecutively played three stimulus signals was perceived as different from the other two or whether all three consecutively played three stimulus signals were perceived as three times the same sound;

c3) deriving a value from said information received from said user;

wherein said result of said distinction test is dependent on said value.

It is possible to choose said three stimulus signals such that one of said two stimulus signals is played exactly once, in which case it can be advantageous to force the user to identify one of the three played stimulus signals as different from the other ("forced choice"; the answer "all three seemed equal" excluded). It is, however possible, to allow the answer "all three seemed equal".

On the other hand, it is possible to allow for a free choice of said three stimulus signals played to the user, in which case playing three times the same stimulus signal would be possible, so that the corresponding answer of the user would be allowed.

In one embodiment, before step A), the step of

G) determining a gain model suitable for said user and using said gain model during step A);

is carried out. A gain model represents the basic amplification characteristic in dependence of input level and frequency (basic frequency-dependent amplification function). The determination of gain models is a well-known procedure in the fitting of hearing devices.

Carrying out said distinction test using said before-determined gain model can lead to more reliable results, in particular if stimulus signals are used, which differ strongly with respect to their most prominent frequency.

In one embodiment, before step A), the step of

L) adjusting said two stimulus signals to substantially the same loudness;

is carried out. This way, it can be avoided that the user perceives signals as different, which he otherwise would not be able to distinguish (with respect to their frequency contents), only because of there is a loudness difference between them. Step L) can be accomplished, e.g., by playing said two stimulus signals to the user and adjusting their output level until the user says that he perceives the two stimulus signals as having the same level (note that "loudness" is a subjective magnitude, individual to the perceiving person). It can be advantageous to adjust said two stimulus signals to having the same signal power, e.g., the same signal pressure level (SPL), before carrying out step L).

In one embodiment, the frequency contents of said two stimulus signals is related to a test frequency, and method comprises the steps of carrying out step A) at least twice for the same test frequency;

adjusting said at least one parameter in dependence of the results of said distinction tests.

An improved setting of said parameter can be achieved when it is based on more reliable data. This can be achieved in the indicated way. A detailed evaluation, in particular using statistical methods, of the results of the distinction tests can lead to improved parameter settings and thus to higher contentness of the user with his hearing system. Step A) can advantageously be carried out at least 3 or 4 times, preferably at least 5 or 6 times. Usually, carrying out step A) 12 to 15 times will be advantageous, whereas more than 20 or 25 times tend to strain the user more than would be justified by the achieved increase in reliability.

In one embodiment, the frequency contents of said two stimulus signals is related to a test frequency, and said method comprises the steps of carrying out step A) at least once for each of at least two different test frequencies;

adjusting said at least one parameter in dependence of the results of said distinction tests.

Investigating said user's ability to distinguish between two stimulus signals which differ in their frequency contents at two or more different frequencies will usually give a better judgement on the user's candidacy for the use of frequency transposition, and also the parameter settings obtained this way are expected to suit the user's needs better. Two, better 3, possibly 4 or 5 different frequencies can be investigated. It is possible to investigate 6 or more different frequencies, but since it can be advantageous to carry out several distinction tests for each test frequency, the number of distinction tests the user is asked to participate in could in that case easily become too high for the user.

Preferably, the results of the several distinction tests are evaluated, in particular statistically, and the adjustment of said at least one parameter depends on the result of said evaluation.

In one embodiment, the method comprises carrying out step A) a multitude of times, each time comprising the steps of x) choosing at least a first and a second stimulus signals from said two stimulus signals;

a) playing the chosen stimulus signals to said user;

b) receiving from said user information in reaction to step a);

c) deriving a value from said information received from said user;

wherein said result of said distinction test is dependent on said value, and wherein said information received from said user is indicative of whether or not said user perceived one of said chosen stimulus signals as different from at least one other of said chosen stimulus signals and/or indicative of which one of said chosen stimulus signals has been perceived by said user as different from at least one other of said chosen stimulus signals.

In one embodiment, said value derived in step c) is indicative of the agreement or disagreement, respectively, between said information received from said user and the relation between said chosen stimulus signals.

For example, one value, e.g., 1 (one), could be granted if the user's perception of the stimulus signals is in agreement with the true relation between the stimulus signals, and another value, e.g., 0 (zero), could be granted if the user's perception of the stimulus signals is different from the true relation between the stimulus signals. In case of a disagreement between the user's perception and true relation between the stimulus signals, one could furthermore differentiate between a perception of a difference where the stimulus signals were identical ("false positives") and a perception of no difference where the stimulus signals were different. These two cases could be assigned different values and/or only one of them could be evaluated or both could be evaluated in a different manner.

Such a value could be termed "agreement value" since it is related to the kind or type or amount of agreement between the user's perception and the true relation between the stimulus signals. Such a value can be considered to be indicative of the relation between said information received from said user and the true relation between said chosen stimulus signals.

In one embodiment, the method comprises the step of

D) statistically evaluating said values derived in step c) for said multitude of times of carrying out step A), wherein said adjusting said at least one parameter is dependent on the result of said statistical evaluation.

In one embodiment, the method comprises repeating step A) after step B). This can be valuable to verify that the parameter adjustment has improved the user's perception.

The arrangement according to the invention comprises a signal processing unit comprised in said hearing system, for carrying out frequency transposition of audio signals, which frequency transposition depends on at least one parameter;

a sound generating unit for generating stimulus signals;

a user interface for receiving user input;

a control unit operationally connected to said signal processing unit, said sound generating unit and said user interface, and adapted to carrying out a distinction test for examining the ability of a user of said hearing system to distinguish between two stimulus signals which differ in their frequency contents;

wherein said control unit is furthermore adapted to adjusting said at least one parameter in dependence of the result of said distinction test.

Said sound generating unit is preferably comprised in said hearing system.

Said sound generating unit may be part of said signal processing unit.

Said user input generally reflects input from the user of the hearing system. It may be entered by the user, but possibly is entered by a hearing device professional such as a hearing device fitter or an audiologist.

In one embodiment, said arrangement is a hearing system. In this case, it would be possible that the user himself would adjust said at least one parameter, possibly without or largely without external assistance.

The advantages of the arrangements correspond to the advantages of corresponding methods.

Further preferred embodiments and advantages emerge from the dependent claims and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. The described embodiments are meant as examples and shall not confine the invention.

DETAILED DESCRIPTION OF THE INVENTION

Figure 1:
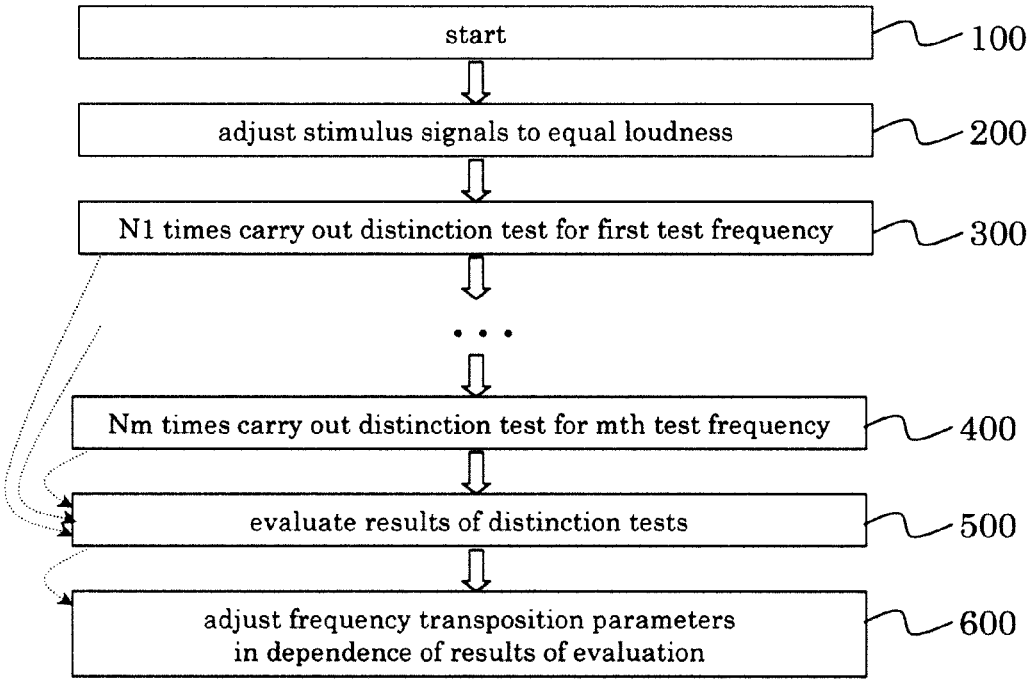
FIG. 1 a block diagram of a method according to the invention.

FIG. 1 shows a block diagram of a method according to the invention. In step 100, the procedure for adjusting at least one parameter influencing a frequency transposition in a hearing system starts. In optional step 200, stimulus signals to be used later in the procedure are adjusted to equal loudness (with respect to the perception of a user of the hearing system). In steps 300 to 400, distinction tests are carried out for m different test frequencies, wherein Ni (i=1, . . . , m) distinction tests are carried out for the mth test frequency. The distinction tests are described in more detail in FIG. 2.

In step 500, the results of the distinction tests are evaluated, e.g., using statistical methods. In step 600, finally, said at least one parameter is adjusted in dependence of the evaluation.

Figure 2:
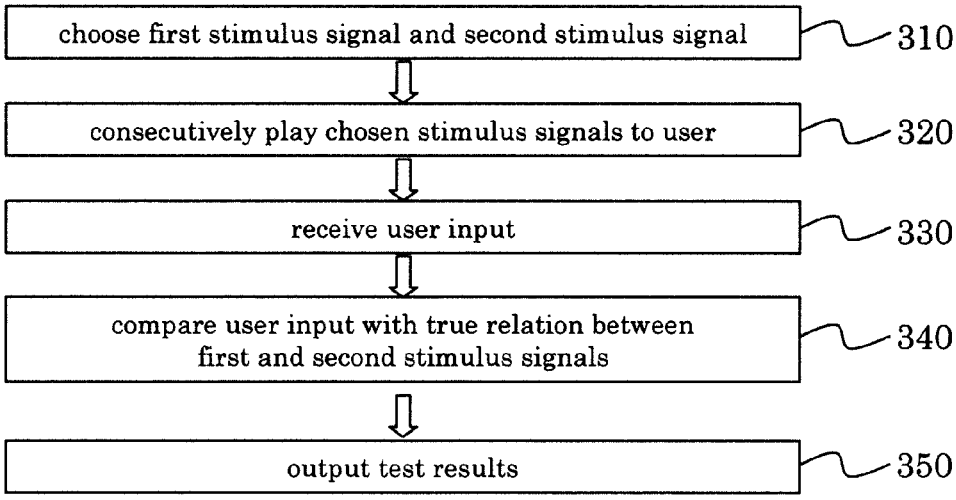
FIG. 2 a block diagram of a distinction test.

FIG. 2 shows a block diagram of a distinction test. The distinction test is a test for examining said user's ability to distinguish between two stimulus signals which differ in their frequency contents. In step 310, from typically two different stimulus signals, a first and a second stimulus signals are chosen; it is also possible to choose a third stimulus signal and possibly even further stimulus signals from said two different stimulus signals. The choice of the at least two stimulus signals can, e.g., be a random choice.

In step 320, the chosen stimulus signals are consecutively played to the hearing system user. Upon perception of the stimulus signals played to him, the user will, in step 330, provide a user input. The user input provides user information indicative of whether the user perceived the played stimulus signals as a repetition of always the same sound or as sounds of which at least one is different, and/or the user input provides user information indicative of which of said consecutively played stimulus signals was perceived as different from the others.

In step 340, the user information is evaluated, in particular by comparing it to the true relation between the played stimulus signals. In step 350, finally, the test results, i.e. the results obtained in step 340, are output.

It is possible to carry out the procedure for each ear separately, or for both ears simultaneously.

Figure 3:
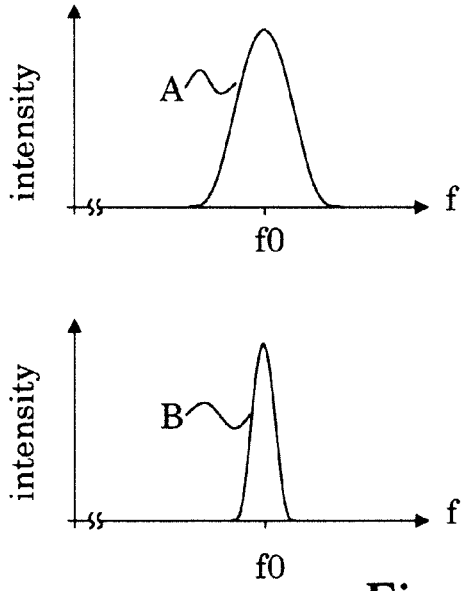
FIG. 3 an illustration of a pair of stimulus signals.
Figure 4:
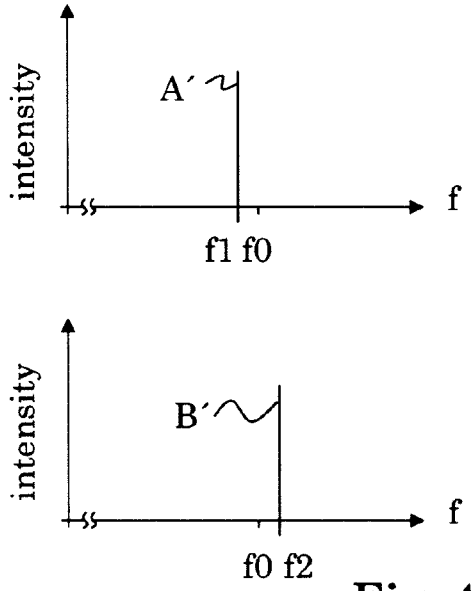
FIG. 4 an illustration of a pair of stimulus signals.
Figure 5:
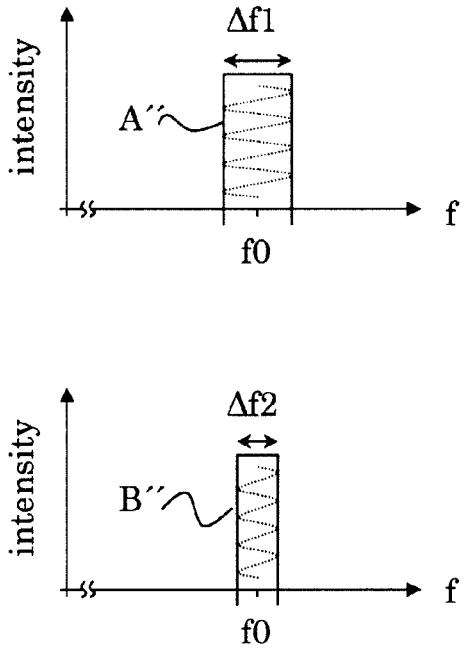
FIG. 5 an illustration of a pair of stimulus signals.

In FIGS. 3, 4 and 5, different examples of pairs of stimulus signals are illustrated, for a test frequency f0. The stimulus signals played to the user during a distinction test, can be chosen from one of these pairs (cf. step 310 in FIG. 2). The horizontal axis is a preferably logarithmical frequency axis (f), and the vertical axis is an intensity, e.g., an SPL. The illustrated signals are rather easily to generate and can preferably be generated in a hearing device of the hearing system.

FIG. 3 illustrates narrow-band noise signals centered around f0 and having different widths. Typical widths for the noises are half an octave to 2 octaves for the wider noise and half an octave to a second or a third for the narrower noise. Such noise signals can be generated, e.g., by band-pass filtering white or pink or other noise.

FIG. 4 illustrates sine-signals of frequencies f1, f2 close to f0, having substantially the same distance interval with respect to f0. The intervals f0-f1 and f2-f0 are typically between a second and an octave.

FIG. 5 illustrates warbling sine-signals with center frequency f0, having different warbling amplitudes Δf1 and Δf2, respectively. The warbling is illustrated by the dotted lines and may have a frequency of the order of 1 Hz. The warbling amplitudes Δf1, Δf2 have typically the same widths as mentioned above for the widths of the noises in FIG. 3.

Typical test frequencies are in the range 0.8 kHz to 8 kHz, more typically in the range 1.2 kHz to 6 kHz.

Concrete Example

In this example, the frequency transposition to be optimized for the user is a non-linear frequency compression (non-linear with respect to a linear Hertz scale, but linear on a logarithmic Hertz scale), e.g., as defined in the above-mentioned EP 1'441'562 A2. It is configurable by setting a cutoff frequency fc and a compression rate CR. The compression rate CR defines the ratio of the frequency width of an interval of an input audio signal to the frequency width of an interval of an output audio signal. E.g., compression rate CR is the ratio of the logarithm of an input bandwidth in Hertz and the logarithm of an output bandwidth in Hertz.

Compression takes place only above the cutoff frequency fc and causes a down-shifting. When measured in Hertz, higher frequencies are shifted more than lower ones.

Figure 6:
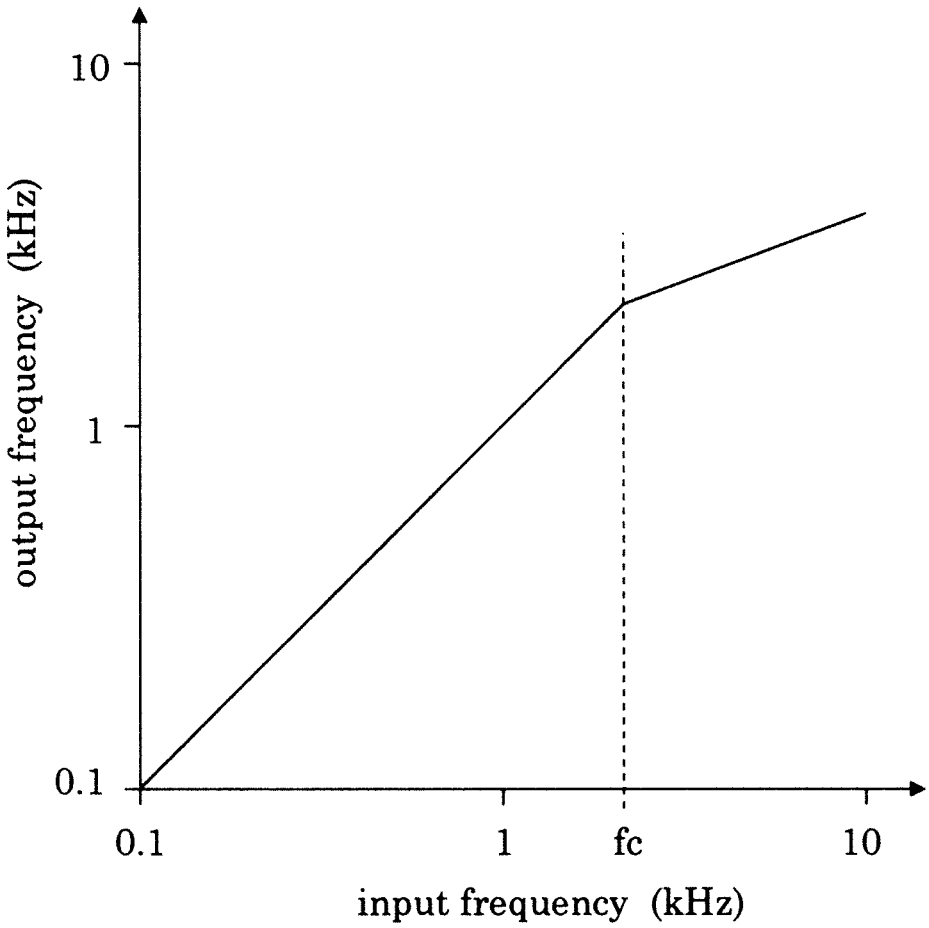
FIG. 6 an illustration of frequency compression.

FIG. 6 is an illustration of frequency compression as described above.

For the frequency transposition to be optimized for the hearing system user, the cutoff frequency fc is preferably adjustable within a pre-defined range, for example with a minimum cutoff frequency of fc_min=1.5 kHz and a maximum cutoff frequency of fc_max=3 kHz. Preferably, the test frequencies for which distinction tests are performed lie within this range. In the present example, the compression rate CR has a pre-defined value, e.g., in the range of 1.5:1 to 3:1. It is also possible to choose frequency-dependent compression rates CR. And it is also possible to derive a value for the compression rate CR from the results of the distinction tests.

In the present example, the only parameter to be adjusted in dependence of the results of the distinction tests is the cutoff frequency fc.

Distinction tests are performed at m=3 different test frequencies f0, namely 1.5 kHz, 2 kHz and 3 kHz.

At each of these test frequencies f0, the test is repeated several times (Nm times), preferably five to fifteen times (Ni=5 . . . 15), for example twelve times (N1=N2=N3=12).

For each distinction test, two stimulus signals are chosen from two narrow-band noises centered about the corresponding test frequency f0 (cf. FIG. 3) and played to the user one after the other. Accordingly, if the two stimulus signals from which the stimulus signals to be played are chosen are labelled A and B, respectively, (cf. FIG. 3), one of the stimulus signals pairs A-A, A-B, B-A, B-B will be played during each distinction test. Upon perceiving a stimulus signals pair, the user will indicate, e.g., by telling his hearing device fitter or by manipulating an appropriate button of a user interface of the hearing system, whether he perceived the stimulus signals pair as two times the same sound or as two different sounds.

Preferably, the distinction test results are represented as percentage values p, varying between 100% for agreement between the user's perception of the agreement or disagreement between the played stimulus signals and the true agreement or disagreement between the played stimulus signals (perfect distinction), and 0% if the user perceived equal stimulus signals as different stimulus signals or different stimulus signals as equal stimulus signals. The results of different test frequencies are preferably averaged to yield an averaged value p_avg:

$$p_\text{avg}=\tfrac{1}{3}\times(p(1.5\text{ kHz})+p(2\text{ kHz})+p(3\text{ kHz}))$$

The averaged value p_avg will amount to 50% if the user can only guess (no distinction).

The cutoff frequency fc is preferably calculated such that $$p_\text{avg}=100\%\rightarrow fc=fc_\text{max (i.e. 3 kHz)}$$

$$p_\text{avg 50\%}\rightarrow fc=fc_\text{min (i.e. 1.5 kHz)},$$

i.e. such that if the user's perception is fully correct in all distinction tests, the highest possible cutoff frequency is chosen, and if the user input is always in disagreement with the true relation between the stimulus signals, the lowest possible cutoff frequency is chosen. For intermediate values of p_avg, fc should be interpolated between fc_min and fc_max.

For fc_min=1.5 kHz and fc_max=3 kHz, the cutoff frequency fc can therefore be obtained as $$fc=p_\text{avg}\times 3\text{ kHz}.$$

It is possible to use the described procedure for determining candidacy of a user for the use of frequency transposition. E.g., if p_avg is above 90%, frequency transposition could be switched off, whereas frequency transposition would be used with the above-described parameter (fc) if p_avg 90%.

Of course, more elaborate schemes for determining parameter settings from the results of the distinction test can be chosen.

In particular, it is possible to carry out distinction tests in an adaptive fashion. In that case, the two stimulus signals to choose from can be chosen in dependence of results of previous distinction tests. E.g., one could start with easily distinguishable stimulus signals, e.g., a 1.5 octaves wide noise signal and a noise signal of a second only (cf. FIG. 3), and if in one or more distinction tests with these stimulus signals, the user input is in sufficiently good agreement with the really played stimulus signals, a noise signal of only one octave width and a noise signal of a width of a second can be used in further distinction tests, and so on, until the user inputs become wrong or unreliable.

It is possible to use static frequency compression, and it is possible to use dynamic frequency compression. In the latter case, at least one parameter related to the frequency compression is altered with time, in particular in dependence of incoming signals.

Figure 7:
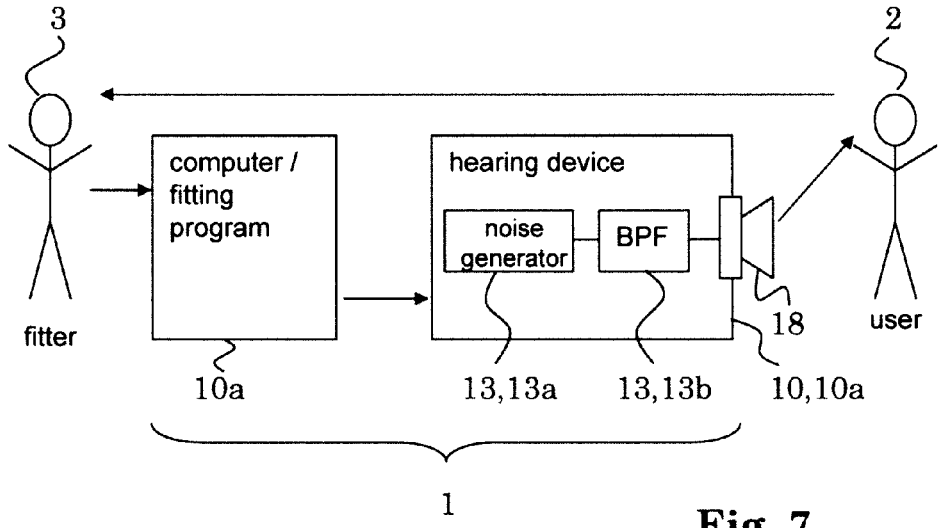
FIG. 7 an illustration of a method and an arrangement according to the invention.

FIG. 7 is an illustration of a method and an arrangement 1 according to the invention. The arrangement 1 comprises a computer 1*a* with a fitting program and a hearing system 10 of which only one hearing device 10*a* is illustrated.

The hearing device comprises an output unit 18, e.g., a loudspeaker, and a sound generating unit 13 comprising a noise generator 13*a* and a band pass filter 13*b*.

For a fitting session, a hearing device professional 3 and user 2 of hearing system 10 are present. Hearing device professional 3 operates the computer 1*a* with the fitting program, through which hearing system 10 is controlled at least in so far as stimulus signals are generated by hearing system 10 in the way it is prescribed by said fitting program. Having perceived the two or more stimulus signals of a distinction test, the user will communicate his answer to hearing device professional 3 as indicated by the right-to-left arrow. Hearing device professional 3 enters the user input into computer 1*a* in which the evaluation and parameter adjustments take place.

Figure 8:
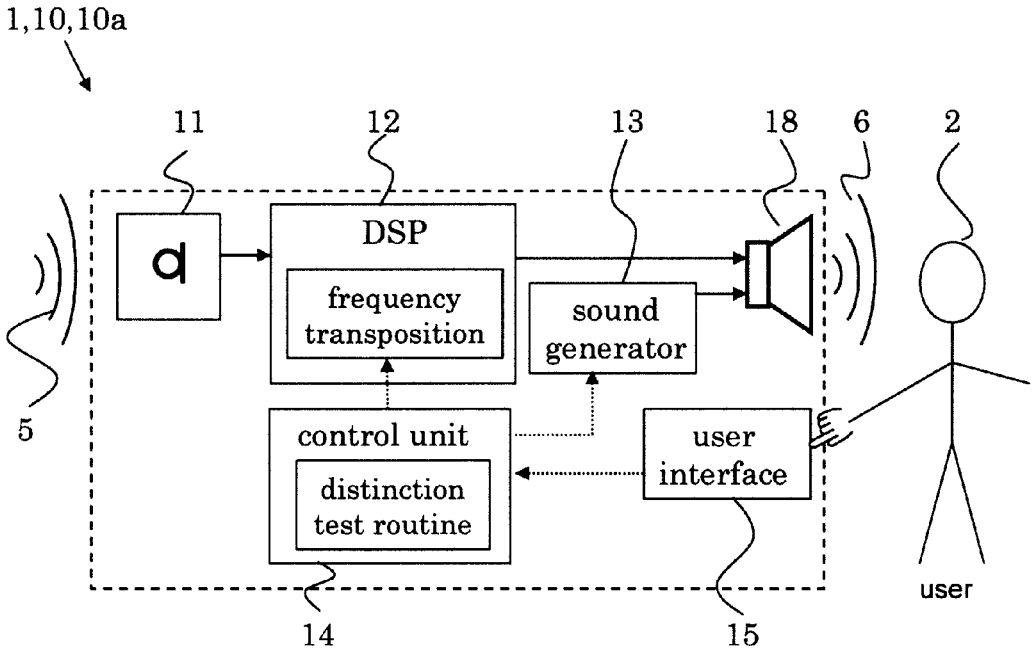
FIG. 8 an illustration of an arrangement according to the invention.

FIG. 8 is an illustration of another arrangement 1 according to the invention. Solid arrows represent audio signals, dotted arrows indicate control signals or data. In this embodiment, user 2 can, fully or substantially without external help, carry out a procedure for fitting a hearing device with frequency transposition as sketched above. All necessary resources are provided within the hearing system 10 or even within the hearing device 10*a*.

Hearing device 10*a* comprises an input unit 11, e.g., a microphone, a signal processing unit 12, a sound generating unit 13, a control unit 14, a user interface 15 and an output unit 18, e.g., a hearing device receiver.

During normal operation of the hearing device 10*a*, incoming acoustic sound 5 is converted into audio signals, which are processed in signal processing unit 12. The processing comprises frequency transposition of at least a portion of said audio signals, which is dependent on at least one parameter, which can be controlled or set by control unit 14. Control unit 14 furthermore controls sound generating unit 13, so that stimulus signals are generated as needed for carrying out distinction tests, and receives input from user interface 15. Control unit 14 ensures that distinction tests are carried out and evaluated properly, and it may, e.g., instruct sound generating unit 13 to generate commands and messages to be played to the user 2 so as to instruct user during the fitting procedure.

LIST OF REFERENCE SYMBOLS

1 arrangement, arrangement for fitting a hearing system with frequency transposition to the hearing preferences of the hearing system user
1*a* computer with fitting program
2 hearing system user
3 hearing device professional, audiologist, fitter
5 incoming signals, incoming sound
6 signals to be perceived by the user, outgoing sound
10 hearing system
10*a* hearing device
11 input unit, microphone arrangement, acoustic-to-electrical converter
12 signal processing unit
13 sound generating unit
13*a* noise generator
13*b* band-pass filter
14 control unit
15 user interface
18 output unit, loudspeaker, receiver, electrical-to-mechanical converter
100-600 steps
A,A',A", B,B',B" stimulus signals

What is claimed is:

1. A method for adjusting a hearing system to the hearing preferences of a user of said hearing system, wherein said hearing system is capable of carrying out frequency transposition of audio signals, which frequency transposition depends on at least one parameter, wherein said at least one parameter includes at least one of a cutoff frequency and a compression ratio, said method comprising A) carrying out a frequency distinction test for examining said user's ability to distinguish between respective frequencies of two stimulus signals which differ in their frequency contents, wherein the frequency distinction test comprises determining whether or not the user perceives the frequencies of two stimulus signals as equal or different; and B) adjusting said at least one parameter in dependence of the result of said frequency distinction test, wherein step B) comprises adjusting at least one of the cutoff frequency and the compression ratio in dependence of a degree with which the user correctly or incorrectly perceives the frequencies of the two stimulus signals as equal or different by identifying the number of times the user correctly or incorrectly perceives the frequencies of the two stimulus signals as equal or different.

2. The method according to claim 1, wherein said frequency distinction test is related to a test frequency, and wherein said two stimulus signals are chosen such that the sum of their audio frequency spectra is substantially symmetrical with respect to said test frequency.

3. The method according to claim 1 or claim 2, wherein said frequency distinction test relates to a test frequency, and wherein each of said two stimulus signals has an audio frequency spectrum, which is substantially symmetrical with respect to said test frequency and/or wherein the audio frequency spectrum of one of said two stimulus signals is substantially symmetrical with respect to the audio frequency spectrum of the other of said two stimulus signals, with said test frequency forming substantially the corresponding symmetry axis.

4. The method according to claim 1, wherein said two stimulus signals are substantially one of noises having different band widths;

narrow-band signals of different frequencies;

narrow-band signals warbling with different warbling amplitudes around substantially the same middle frequency.

5. The method according to claim 1, wherein carrying out said frequency distinction test comprises a2) consecutively playing said two stimulus signals to said user;

b2) receiving from said user information indicative of whether said user perceived the respective frequencies of said two stimulus signals as two times the same sound or as two different sounds;

c2) deriving a value from said information received from said user;

wherein said result of said frequency distinction test is dependent on said value.

6. The method according to claim 1, wherein carrying out said frequency distinction test comprises a3) consecutively playing three stimulus signals to said user, wherein these three are chosen from said two stimulus signals either freely or such that one of said two stimulus signals is played exactly once;

b3) receiving from said user information indicative of which of said consecutively played three stimulus signals was perceived as different from the other two, or indicative of which of said consecutively played three stimulus signals was perceived as different from the other two or whether all three consecutively played three stimulus signals were perceived as three times the same sound;

c3) deriving a value from said information received from said user;

wherein said result of said frequency distinction test is dependent on said value.

7. The method according to claim 1, comprising, before step A) the step of

G) determining a gain model suitable for said user and using said gain model during step A).

8. The method according to claim 1, comprising, before step A) the step of

L) adjusting said two stimulus signals to substantially the same loudness.

9. The method according to claim 1, wherein the frequency contents of said two stimulus signals is related to a test frequency, said method comprising the steps of carrying out step A) at least twice for the same test frequency;

adjusting said at least one parameter in dependence of the results of said frequency distinction tests.

10. The method according to claim 1, wherein the frequency contents of said two stimulus signals is related to a test frequency, said method comprising the steps of carrying out step A) at least once for each of at least two different test frequencies;

adjusting said at least one parameter in dependence of the results of said frequency distinction tests.

11. The method according to claim 1, comprising carrying out step A) a multitude of times, each time comprising the steps of x) choosing at least a first and a second stimulus signals from said two stimulus signals;

a) playing the chosen stimulus signals to said user;

b) receiving from said user information in reaction to step a);

c) deriving a value from said information received from said user;

wherein said result of said frequency distinction test is dependent on said value, and wherein said information received from said user is indicative of whether or not said user perceived one of said chosen stimulus signals as different from at least one other of said chosen stimulus signals and/or indicative of which one of said chosen stimulus signals has been perceived by said user as different from at least one other of said chosen stimulus signals.

12. The method according to claim 11, wherein said value derived in step c) is indicative of the agreement or disagreement, respectively, between said information received from said user and the relation between said chosen stimulus signals.

13. The method according to claim 12, comprising the step of

D) statistically evaluating said values derived in step c) for said multitude of times of carrying out step A), wherein said adjusting said at least one parameter is dependent on the result of said statistical evaluation.

14. The method according to claim 1, comprising the step of repeating step A) after step B).

15. Arrangement comprising a hearing system, comprising a signal processing unit comprised in said hearing system, for carrying out frequency transposition of audio signals, which frequency transposition depends on at least one parameter; wherein said at least one parameter includes at least one of a cutoff frequency and a compression ratio, a sound generating unit for generating stimulus signals;

a user interface for receiving user input;

a control unit operationally connected to said signal processing unit, said sound generating unit and said user interface, and adapted to carrying out a frequency distinction test for examining the ability of a user of said hearing system to distinguish between respective frequencies of two stimulus signals which differ in their frequency contents, wherein the frequency distinction test comprises determining whether or not the user perceives the frequencies of the two stimulus signals as equal or different;

wherein said control unit is furthermore adapted to adjusting said at least one parameter in dependence of the result of said frequency distinction test, wherein said control unit is furthermore adapted to adjusting at least one of the cutoff frequency and the compression ratio in dependence of a degree with which the user correctly or incorrectly perceives the frequencies of the two stimulus signals as equal or different by identifying the number of times the user correctly or incorrectly perceives the frequencies of the two stimulus signals as equal or different.

16. The arrangement of claim 15, which is said hearing system.

17. A distinction test method for adjusting a hearing system to the hearing preferences of a user of said hearing system, wherein said hearing system is capable of carrying out frequency transposition of audio signals, comprising the steps of A) investigating the ability of said hearing system user to distinguish between respective frequencies of two stimulus signals which differ in their frequency contents, wherein investigating the ability of the hearing system user comprises determining whether or not the hearing system user perceives the frequencies of the two stimulus signals as equal or different; and B) adjusting at least one parameter of said hearing system;

wherein said hearing system is capable of carrying out frequency transposition of audio signals, and said frequency transposition is dependent on said at least one parameter, wherein said at least one parameter includes at least one of a cutoff frequency and a compression ratio and wherein step B) comprises adjusting at least one of the cutoff frequency and the compression ratio in dependence of a degree with which the user correctly or incorrectly perceives the frequencies of the two stimulus signals as equal or different by identifying the number of times the user correctly or incorrectly perceives the frequencies of the two stimulus signals as equal or different.

18. The method according to claim 1, wherein the frequency contents of said two stimulus signals are related to a test frequency, and wherein respective intervals of frequencies of said two stimulus signals to the test frequency are within a range from a second to an octave.

19. The method according to claim 18, wherein the test frequency is selected to be between a minimum cutoff frequency and a maximum cutoff frequency associated with the frequency transposition.

20. The method according to claim 1, wherein said at least one parameter includes at least one of a minimum cutoff frequency, a maximum cutoff frequency, or a compression ratio.

21. The method according to claim 1, further comprising determining a candidacy of the user for frequency transposition based on the result of said frequency distinction test.

* * * * *